United States Patent [19]

Stephansen et al.

[11] Patent Number: 4,494,316

[45] Date of Patent: Jan. 22, 1985

[54] APPARATUS FOR DRYING A MOVING WEB

[75] Inventors: Erik Stephansen; Rajeeva Sharma, both of San Jose; Michael Richie, Santa Cruz, all of Calif.

[73] Assignee: Impact Systems, Inc., San Jose, Calif.

[21] Appl. No.: 475,125

[22] Filed: Mar. 14, 1983

[51] Int. Cl.[3] ..... F26B 23/04

[52] U.S. Cl. ..... 34/68; 34/4; 34/41; 34/62; 250/497.1; 250/498.1

[58] Field of Search ..... 34/4, 41, 62, 66, 68, 34/48, 210, 216; 250/453.1, 454.1, 455.1, 492.1, 497.1, 498.1, 522.1

[56] References Cited

U.S. PATENT DOCUMENTS

| | | | |
|---|---|---|---|
| 2,565,570 | 8/1951 | Messinger | 34/41 |
| 3,040,807 | 6/1942 | Chope | 34/48 |
| 3,499,232 | 3/1970 | Zimmermann | 34/68 |
| 3,864,546 | 2/1975 | Cahnman et al. | 34/48 |
| 3,950,650 | 4/1976 | Pray et al. | 34/4 |
| 4,015,340 | 4/1977 | Treleven | 34/4 |
| 4,202,112 | 5/1980 | Von Der Eltz | 34/4 |
| 4,297,583 | 10/1981 | Nerod | 34/4 |

*Primary Examiner*—Larry I. Schwartz

*Attorney, Agent, or Firm*—Flehr, Hohbach, Test, Albritton & Herbert

[57] ABSTRACT

A cross-direction web dryer includes a support structure arranged transversely across the web of moving paper. The drying apparatus has as its main structural support a large diameter structural member which is pivotally mounted on two end supports so that the associated cantilevered heating or drying modules can be rotated away from the moving web when desired. The structural member also provides an electrical wireway or conduit for the power cables to the individual dryer modules. Individual heater modules are arranged so that the cooling air enters a built-in plenum where air pressures are equalized for effective cooling of the quartz lamp heaters in the modules.

12 Claims, 8 Drawing Figures

APPARATUS FOR DRYING A MOVING WEB

This is a continuation-in-part patent application of application Ser. No. 385,688, filed June 7, 1982, expressly abandoned by our communication dated Oct. 21, 1983.

The present invention relates to apparatus for drying a moving web and more particularly to radiant heaters located in the cross-direction of the moving web which may be individually controlled to provide an even moisture profile.

As discussed in a copending application now abandoned, entitled CROSS DIRECTION WEB DRYER, filed July 6, 1982 in the names of Kenneth Ostrow et al., Ser. No. 395,864, in the paper making process where a continuously moving sheet of paper is being produced, it has been known that the drying, which is normally accomplished by cylindrical steam drums, is uneven from edge-to-edge. In other words, streaks occur. This results in an output of uneven quality. The above copending Ostrow application discloses the benefits of efficient correction of variation of moisture content across a web of paper and a control system for effectively accomplishing this objective. More specifically, the control system operates on individual dryer modules of a cross-direction web dryer. The present invention discloses and claims details of the dryer unit per se.

Cross-direction dryer units have been suggested before such as in the Rauskolb U.S. Pat. No. 3,293,770. Here four elongated burner units are placed across a moving web. And each burner unit has individual hand operated valve controls so that the burners can attempt to eliminate dry or wet streaks across the web. The use of infrared heaters for drying textiles and papers, etc., for example, by the use of a fused quartz radiating surface, has been suggested in U.S. Pat. No. 3,864,546 with Cahnman et al. as inventors. Here the heaters are also pivotal about respective axes extending transverse to the direction of displacement of the web to prevent overheating; that is, they are pivoted up when the web stops.

The U.S. Pat. No. 3,499,232 to Zimmermann as inventor illustrates a dryer having removable heating units. Each heating unit has a heating element which has a fused quartz plate at its bottom adjacent the moving web which it is drying. The heating modules or casings have enough mounting clearance so that air flows through the clearances for impingement on the moving web for enhancing the drying effect.

Research, Inc. of Minneapolis, Minn. apparently manufactures a high density radiant heater for tungsten filament tubular quartz lamps. A clear quartz window encloses the lamps to prevent the work piece or material being cooled from being convection cooled by the air cooling of the heater.

In providing an effective dryer unit, the ambient conditions, for example, in a paper making machine are, of course, very severe. Thus, a dryer unit is desired which can easily be installed across the width of a relatively large web of moving paper, for example, to provide a number of dryer modules which have high intensity and high efficiency at low cost; and also provide an overall drying apparatus which is easily maintainable and not subject to failure. Failure of such a device, of course, is very serious in the context of a paper making machine since it may require a shutdown of the entire process.

Thus, it is an object of the invention to provide an improved apparatus for controlling the moisture profile of a moving web.

In accordance with the above object, such apparatus includes an elongated structural member having a length at least as great as the web in a transverse cross-direction and forming the main structural support for the drying apparatus. Support means receive a plurality of dryer modules in a side-by-side relationship and replaceably support them in positions across the web to dry the web. The support means is cantilevered from and fixed to the structural member. There are also fixed support means for rotatably supporting the member at both ends including means therein for rotating the dryer modules into and out of proximity to the web.

Figure 1:
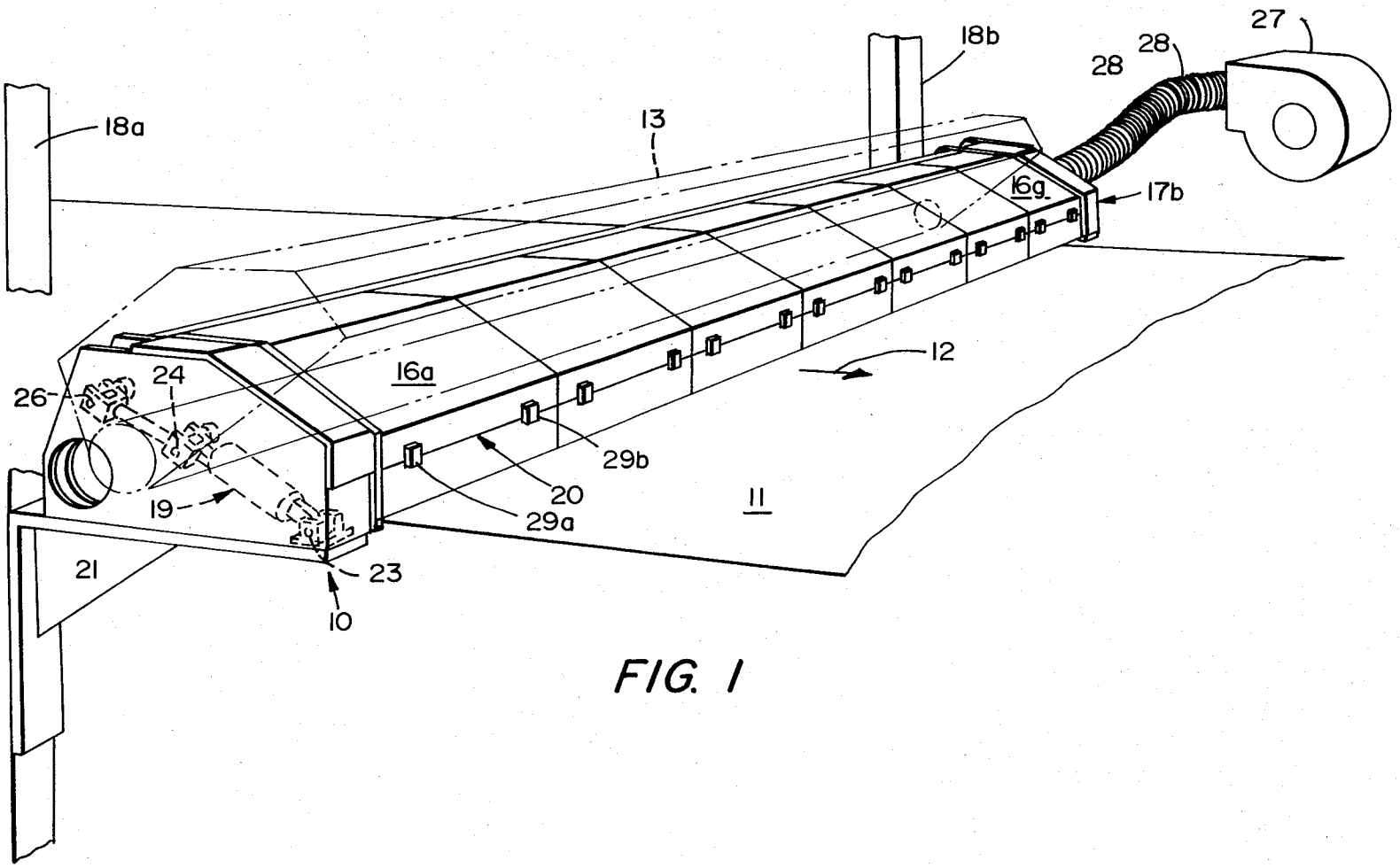
FIG. 1 is a perspective view of apparatus embodying the present invention and showing its installation on a paper making machine.

FIG. 1 shows the drying apparatus 10 embodying the present invention which is located transverse or in the cross-direction to the moving paper sheet 11 having a direction of motion indicated by the arrow 12. In the position shown, the dryer units contained within the apparatus are in very close proximity, e.g., less than one inch, to the moving web 11. The phantom view 13 illustrates the apparatus rotated away from the web to rapidly remove the heat source in the event of a web break and to prevent damage to the individual heating elements.

As discussed in the copending Ostrow application, the dryer has several individually controlled heater modules which are in a side-by-side relationship across the paper to allow for individual zones or slices of the paper to be dried to individual specifications. Apparatus 10 includes several drying units **16*a* through 16*g* with four heater or dryer modules per unit. Of course, the number of units 16 would vary according to the width of the web and the number shown is illustrative only. Each cover for units 16*a* through 16*g* has latches 29*a*, 29*b*** for easy accessibility to the dryer modules.

At each end of the drying apparatus, are support means **17*a* and 17*b* which are mounted on the fixed vertical supports 18*a*, 18*b* respectively. A hydraulic drive system indicated at 19 is built into each end support 17*a*, 17*b*. These, when actuated, rotate the portion of the drying apparatus over the paper as indicated by the phantom view 13 away from the paper and back again in proximity to it. This rotation occurs about a large diameter elongated structural member in the form of a circular conduit shown in phantom at 21. A square shaped member or other equivalent could also be used. The entire pivoted apparatus is cantilevered about this structural member which serves as the main structural support for the drying apparatus. Thus, the ends of the member are journaled in bearings in the end pieces 17***a*, 17*b*.

Each hydraulic actuator unit 19 includes a cylinder 22 which is fixed to the end support at the pivot point 23. The actuator end 24 is pivotally coupled to the central portion 13 of the drying apparatus. End 26 illustrates the extended condition of the piston.

In addition to serving as the main structural support of the drying apparatus, the hollow member 21 also acts as the conduit for electrical wiring within the device.

Cooling air is provided by forced air blower 27 connected by a hose 28 to one of the end panels. In actual practice, either end panel could be suitably used for introducing air into the dryer units 16*a* through 16*g*. Such side-by-side units form an enclosed structure which is a continuous main air plenum 30 (see FIG. 4).

Figure 2:
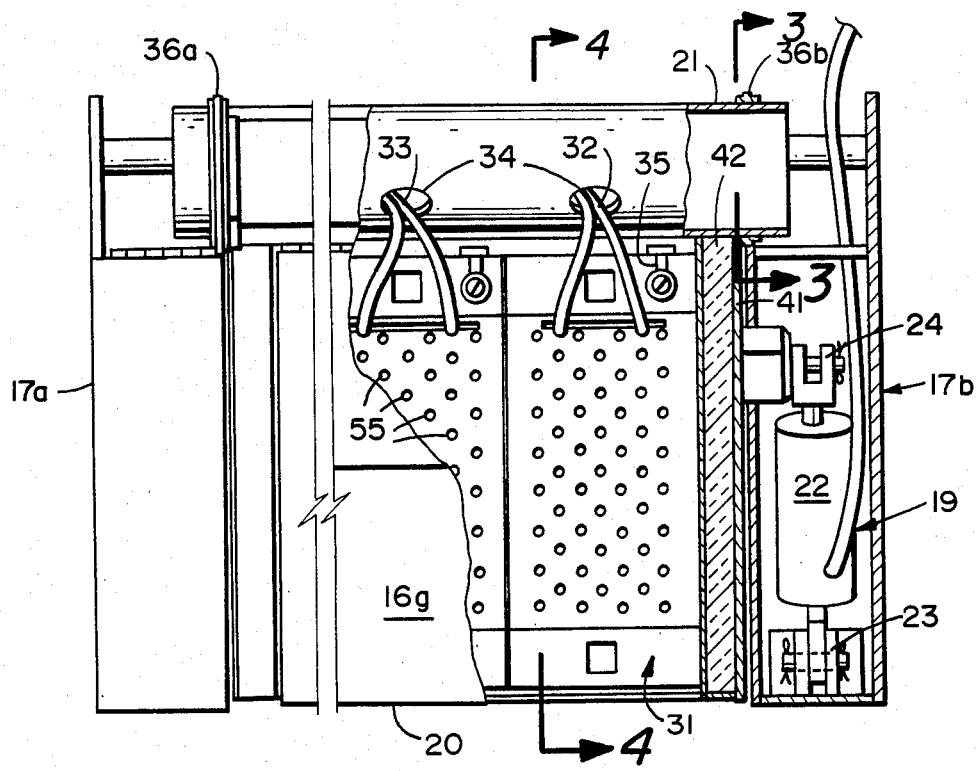
FIG. 2 is an enlarged partially cut away top view of a portion of FIG. 1.

FIG. 2 shows the cover 20 of unit 16*g* broken away, and one of the individual heater modules 31, and a portion of another. They are supported by the pivoted structure, and are replaceable to facilitate repair. The hydraulic actuator 19 is pivotally connected at 24 to an end wall 41 of the center portion. The same structure is present on the opposite end 17*a*.

Modules 31 are individually powered and controlled, as more fully described in the copending Ostrow application, by conductor pairs 32, 33, etc., extending out from apertures 34 in structural member 21 to the heater module itself. Such conductors are of fairly significant size since a typical power output of an individual heater module is 24 kilowatts at 480 volts.

Thus, as is apparent, the member 21 in addition to its structural support function carries and cools (via aperture 34) the electrical conductors which supply energy to the dryer modules.

To insulate the end supports 17, 17*b* from heat, the pivoting center section also has a slab 42 in each end of insulating material.

Figure 3:
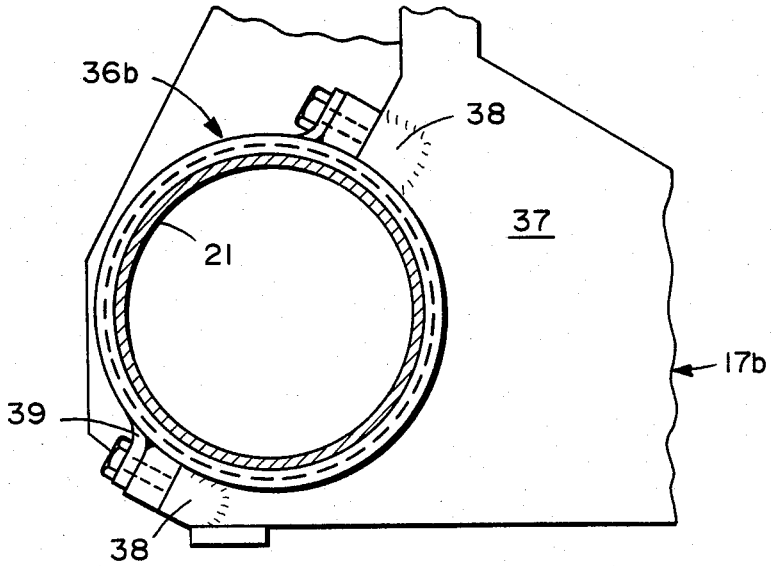
FIG. 3 is a fragmentary cross-sectional view taken along line 3—3 of FIG. 2.

Since the center section of the drying apparatus is pivoted, a pair of bearings are provided in the end sections 17*a*, 17*b* at 36*a* and 36*b*. The bearing is shown in greater detail in FIG. 3 where a fixed bearing support is provided by a wall 37 of end support 17*b* which provides mounting blocks 38 upon which a bearing strap 39 is fastened. The bearing itself is of sintered brass; i.e., a typical journal sleeve bearing.

Figure 4:
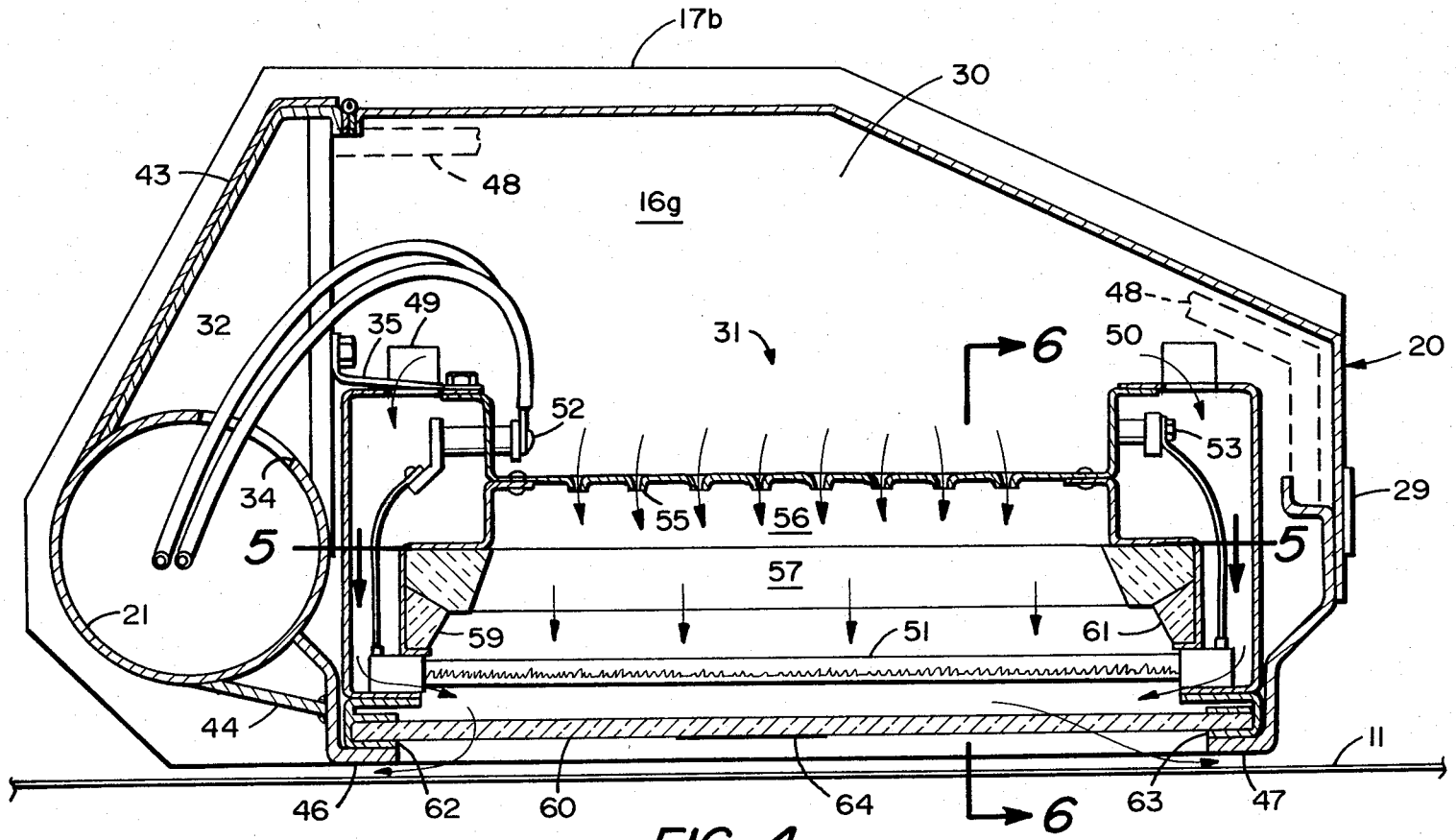
FIG. 4 is a cross-sectional view taken along line 4—4 of FIG. 2.

FIG. 4 is a cross-sectional view of the entire drying unit which better illustrates how the apparatus is effectively fixed to and cantilevered on the main structural member 21. In addition, it provides for replaceably supporting the dryer modules 31 in side-by-side relationship. Specifically, extending from and welded to the member 21 are wing-shaped support portions 43 and 44. Lower portion 44 has a shelf 46 upon which one end of a heater module 31 rests. An opposite shelf portion 47 is supported by spaced brackets 48, shown in dashed outline and partially cut away, which are fixed to wing-shaped bracket 43. These are spaced, for example, every fourth unit 16. Between the shelf areas 46 and 47 is an open space for the quartz lamp heaters 51, of which each dryer unit 37 contains several, to operate on the paper which is immediately below it. The quartz lamp heaters 51 of the heater module 31 have their axes coincident with the direction 12 (FIG. 1) of the moving web. The lamps are supplied energy through the conductors 32, and the terminals 52 and 53 which are connected across heaters 51. A third conductor 35 provides a safety ground connection.

Figure 5:
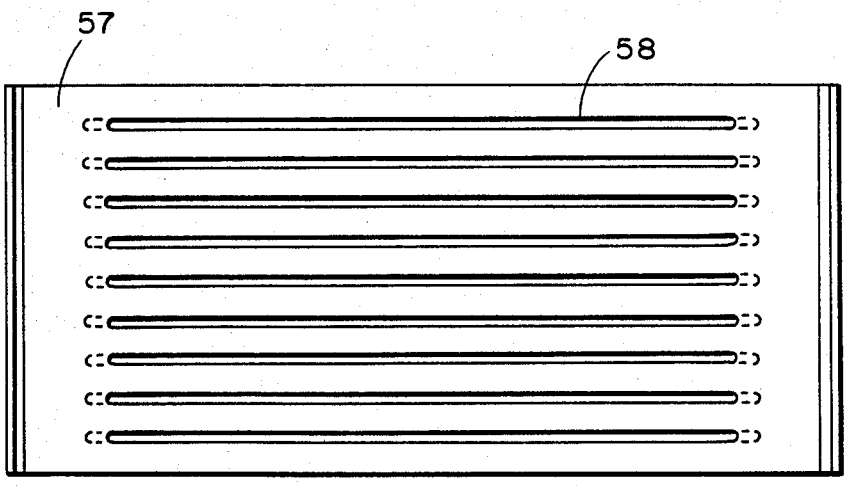
FIG. 5 is a top view of a heater module portion taken along line 5—5 of FIG. 4.

The top of each dryer module is a dimpled plate 54 with a number of holes 55 (see FIG. 2) which admit air into a plenum chamber 56. The air, of course, is supplied by the forced air blower system through the main air plenum 30. Plenum 56 has its bottom side formed by a slotted ceramic slab or tile 57 better shown in FIG. 5. There are approximately as many slots as there are quartz lamp heaters. The slotted ceramic plate 57 is supported within the frame of the dryer module by ceramic interlock blocks 59 and 61. Both these ceramic blocks and the tile itself may be constructed of materials such as alumina.

Additionally, air is picked up by scoops 49 and 50 (see also FIG. 2) which directs air as shown by the arrow, to both ends of quartz heaters 51. The ends of the lamps 51 must be kept cooler than the body since this is the first point of failure. The scoops ensure an adequate air flow.

Closing the bottom of each heater module 31 is a quartz plate 60. The plate is actually split into two portions 60*a* and 60*b*, as better shown in FIG. 6, with a slit 65 occurring in the midline of the plate 60 which is parallel to heater elements 51. In addition, since plate 60 is held only at its ends by U-shaped end pieces 62 and 63, as shown in FIG. 4, slits 66 are formed between plates of adjacent heater modules. Slits 65 and 66 provide for the cooling air to escape to the space between the sheet material 11 and plate 60 and then exiting, as indicated by the arrows of FIG. 4, at the front and rear of the modules 31.

As partially illustrated in FIG. 4, an optical coating 64 may be applied to either side of the quartz glass plate 60 to eliminate or reduce the amount of visible light. This is for the benefit of nearby workers who might otherwise be adversely affected or annoyed by such light. Although only one midline slit 65 in the plate is shown, depending on the application, more could be used with greater or narrower width to provide proper air flow and back pressure.

Figure 6:
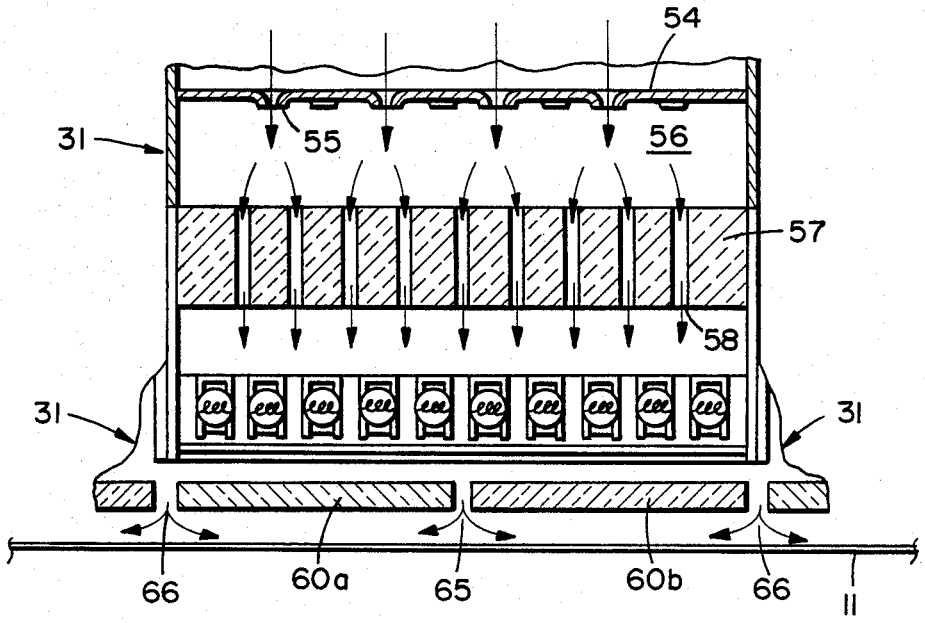
FIG. 6 is a partial cross-sectional view taken along line 6—6 of FIG. 4.

The foregoing has several advantages. It provides for the exhaust of the cooling air from the quartz lamps and at the same time utilizes this exhaust air to provide relatively cool air between the moving web and the heating modules. In other words, relatively cool air is provided between the paper and the heater module, since as is illustrated by FIG. 6, the air circulation continuously sweeps away the moist air from the surface of the web 11 which is being dried via the slits 65 in the quartz plate and side slits 66. There is also a protective purpose of keeping the web away from the hot heater thus reducing the fire hazard. The glass plate prevents paper or web material from hitting against the heater elements which, depending on their type, may not have high mechanical strength. Finally, back-flow pressure is provided for plenum 56 to give uniform distribution of air to all modules 31.

Depending on application, where, for example, the heating elements do not need shielding, the glass plate can be totally eliminated to allow free flow of air from the quartz lamps to the paper sheet.

FIG. 6 shows a cross-section of the heater module with its dimpled hole top plate 54 admitting air into plenum 56 which then after being equalized by the plenum flows equally well through all of the slots 58 in ceramic heater tile 57. Several quartz heater tubes or lamps 51 have been indicated which are somewhat offset from the slots 58 so they do not receive a direct air flow on them. In addition, this offset prevents radiant energy from being transferred by "line of sight"

through the slots to the plenum chamber 56. This air, of course, provides cooling for both the heater envelopes themselves which because they are quartz do not absorb much of the radiant energy but a sufficient amount to still require cooling.

Figure 7:
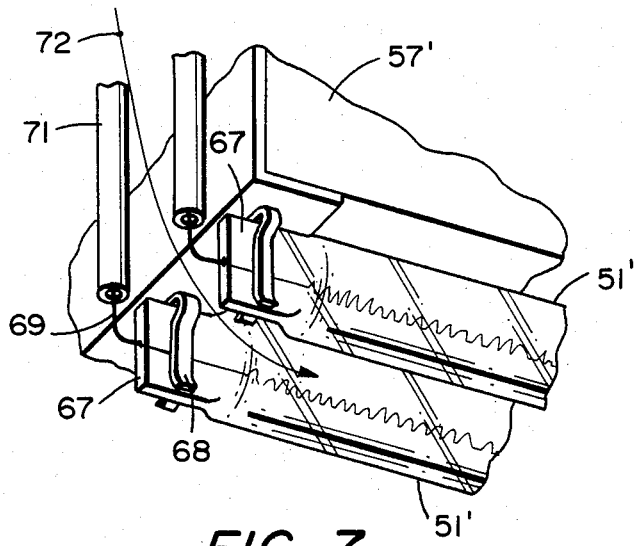
FIG. 7 is a fragmentary perspective view showing an alternative embodiment of the invention.
Figure 8:
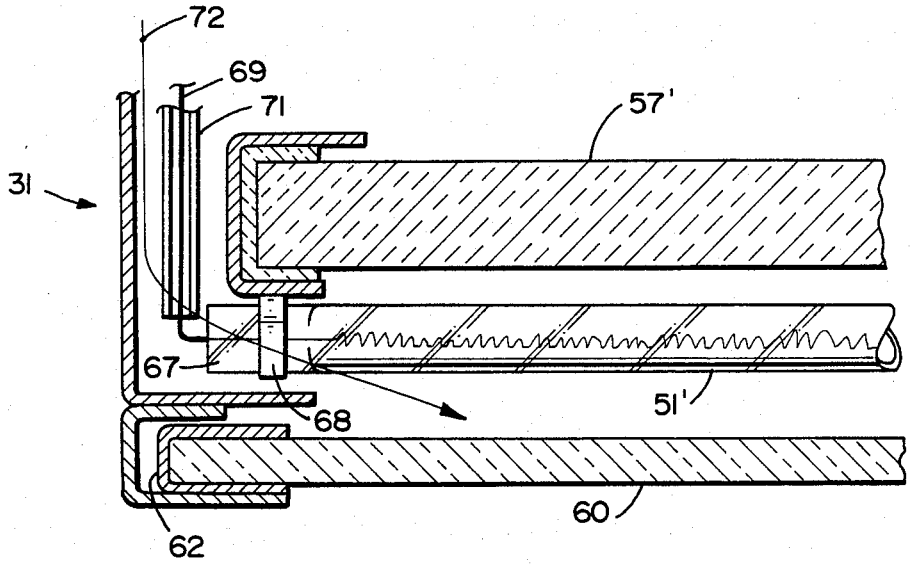
FIG. 8 is a fragmentary cross-sectional view of the alternative embodiment but similar to FIG. 4.

FIGS. 7 and 8 shown an alternative embodiment of the heating elements which are now designated 51'. As discussed in conjunction with FIG. 4, the air scoops 49 and 50 are used to specifically direct air to cool the ends of the heater elements. Because of the high temperatures involved it has been found that the cooling of these portions of the heater elements are critical. As shown in FIG. 4, the heater elements are capped with box-type enclosures which are standard from the manufacturer.

However, as shown in FIG. 7, these enclosures have now been removed leaving only the pinched flat ends 67 of the heater elements. These ends are then retained by clips 68. And extending from each end are the electrical conductors 69 as shielded by the insulating sleeves 71.

The air flows, for example, from one air scoop as shown by the arrow 72. It is believed that a Venturi type effect speeds up the air flow or the volume of the air flow due to the constriction caused by the cylindrical portion of the tube 51' relative to the pinched off flat portion 67. Thus, the critical end portion of the heating element is cooled more effectively. And this is also true as mentioned above because with no standard end caps the ends 67 are now substantially fully exposed to the cooling air. Note that the clips 68 cover only a small portion of the surface area of the ends 67 to provide for better cooling.

Another modification which has been made in the embodiment of FIGS. 7 and 8 is, as best shown in FIG. 8, that the insulating heater tile 57 as illustrated in FIG. 6 has been modified to eliminate the slots 58 to provide a solid barrier 57'. Thus, this causes substantially the entire air flow from the plenum 30 (see FIG. 4 which extends across the entire enclosed structure) to flow via the air scoops 49 and 50 first over the ends 67 of the heater elements 51' and then over the elements themselves.

And thereafter, of course, as discussed above, the quartz protective plate 60 contains the slits 65 and 66 (see FIG. 6) to allow the cooling air to escape in the space between the paper 11 and the plate 60.

Since the tile 57' is now solid, the plenum chamber 56 as shown in FIGS. 4 and 6 may be eliminated; alternatively, plate 54 may be solid without holes 55.

Thus, in summary, the construction of the dryer unit is structurally very straightforward because of the use of structural member 21 which supports the remainder of the cantilevered drying apparatus. In addition, by merely opening one of the covers 20 and removing the electrical connections, any individual dryer module 31 may be rapidly replaced. Since the individual quartz heating lamps are held at each end by clips, they are easily removed when the heater module is out of the frame. Finally, the air circulation through the heater modules and for that matter the remainder of the drying apparatus serves to equalize temperatures, preventing hot spots, and in general, to prolong the life of all components.

What is claimed:

1. Apparatus for drying a moving web comprising:

an elongated structural member having a length at least as great as said web in a transverse cross-direction and forming the main structural support for said drying apparatus;

a plurality of dryer modules;

support means for receiving said dryer modules in a side-by-side relationship and for replaceably supporting them in positions across said web to dry said web, said support means being cantilevered from and fixed to said member;

fixed support means for rotatably supporting said structural member at both ends including means therein for rotating said dryer modules into and out of proximity to said web;

forced air cooling means said support means forming an enclosed structure that carries cooling air to said dryer modules and including a blower attached to said support means for providing said cooling air;

each of said dryer modules including a plurality of spaced, parallel, heater elements in the form of glass tubes having their integral ends pinched flat with electrical conductors extending therefrom, and including a pair of retaining clips fastened to said flat ends, said flat ends and clips providing for free flow of said cooling air to cool said glass tubes.

2. Apparatus as in claim 1 including electrical power cables for said dryer modules carried by said structural member which acts as a conduit and exiting said conduit at respective modules via apertures cut into said conduit along its length.

3. Apparatus as in claim 1 where each of said fixed support means includes a built-in hydraulic actuator for pivoting said cantilevered support means.

4. Apparatus as in claim 1 where each dryer module includes a plenum chamber for equalizing air pressure from said forced air cooling means.

5. Apparatus for drying a moving web comprising:

an elongated structural member having a length at least as great as said web in a transverse cross-direction and forming the main structural support for said drying apparatus;

a plurality of dryer modules;

support means for receiving said dryer modules in a side-by-side relationship and for replaceably supporting them in positions across said web to dry said web, said support means being cantilevered from and fixed to said member;

fixed support means for rotatably supporting said structural member at both ends including means therein for rotating said dryer modules into and out of proximity to said web;

forced air cooling means said support means forming an enclosed structure that carries cooling air to said dryer modules and including a blower attached to said support means for providing said cooling air;

each dryer module including a plenum chamber for equalizing air pressure from said forced air cooling means;

and each dryer module including a plurality of spaced, parallel, elongated heater elements, said plenum chamber having a bottom wall formed of a ceramic slab having a plurality of slots aligned with said heater elements to allow cooling air to pass from said plenum chamber to said heater elements, said elements being offset from said slots of said ceramic slab to prevent radiant energy from said heater elements being transferred through said slots to said plenum chamber.

6. Apparatus as in claim 1 where each of said dryer modules include heater elements with ends connected to electrical power such modules including air scoops for directing cooling air to said ends.

7. Apparatus as in claim 6 where said air scoops provide substantially all of said cooling air both to said ends and to said heater elements.

8. Apparatus as in claim 6 where said heater elements include glass tubes pinched off at their two ends said ends being substantially exposed to said cooling air.

9. Apparatus as in claim 8 where said pinched ends in combination with the adjacent cylindrical portions of said glass tubes causes a Venturi effect due to the relative constriction of said tubes.

10. Apparatus for drying a moving web comprising:

an elongated structural member having a length at least as great as said web in a transverse cross-direction and carrying a plurality of side-by-side heater modules for drying said web, and including an air plenum connected to all of said heater modules;

forced air cooling means for supplying cooling air to said air plenum;

each dryer module including a plurality of spaced, parallel, elongated heater elements in close proximity to said web and including a solid barrier carried by said dryer module between said heater elements and said web, substantially transparent to the heat producing radiation of said heater elements, and including at least one narrow slit in said barrier parallel to said heater elements for allowing the passage of air from said air plenum to the space between said web and barrier.

11. Apparatus as in claim 10 where said barrier includes a coating to filter out visible radiation.

12. Apparatus as in claim 10 where said barrier is retained at its ends only, to form an additional slit for air flow between adjacent heater modules.

* * * * *